US008715029B2

(12) United States Patent
Bishop

(10) Patent No.: US 8,715,029 B2
(45) Date of Patent: May 6, 2014

(54) ROBOTIC CONSTRUCTION CUBES

(76) Inventor: Forrest Frederick Bishop, Seattle, WA (US)

( * ) Notice: Subject to any disclaimer, the term of this patent is extended or adjusted under 35 U.S.C. 154(b) by 1122 days.

(21) Appl. No.: 12/012,303

(22) Filed: Feb. 1, 2008

(65) Prior Publication Data

US 2008/0280522 A1 Nov. 13, 2008

Related U.S. Application Data

(63) Continuation-in-part of application No. 11/801,904, filed on May 11, 2007.

(51) Int. Cl.
*A63H 33/04* (2006.01)
*A63H 33/08* (2006.01)

(52) U.S. Cl.
USPC ..... 446/85; 446/108; 446/124; 446/127

(58) Field of Classification Search
USPC ..... 446/85, 108, 114, 115, 120, 121, 124, 446/125, 127; 273/153 R, 156, 157 R
See application file for complete search history.

(56) References Cited

U.S. PATENT DOCUMENTS

| | | | | | |
|---|---|---|---|---|---|
| 2,020,562 | A | * | 11/1935 | Miller | 446/127 |
| 3,552,817 | A | * | 1/1971 | Marcolongo | 312/107 |
| 3,690,672 | A | * | 9/1972 | Dreyer | 273/155 |
| 4,345,762 | A | * | 8/1982 | Lebelson | 273/157 R |
| 5,086,999 | A | * | 2/1992 | Mullen | 244/159.4 |
| 5,267,863 | A | * | 12/1993 | Simmons, Jr. | 434/96 |
| 5,775,046 | A | * | 7/1998 | Fanger et al. | 52/590.1 |
| 5,826,873 | A | * | 10/1998 | Lavermicocca | 273/157 R |
| 6,286,936 | B1 | * | 9/2001 | Kumon et al. | 347/55 |
| 6,386,936 | B1 | * | 5/2002 | Gebara | 446/117 |
| D506,790 | S | * | 6/2005 | Gee | D21/479 |
| 7,988,516 | B2 | * | 8/2011 | Bishop | 446/85 |
| 7,988,517 | B2 | * | 8/2011 | Bishop | 446/85 |
| 2004/0102132 | A1 | * | 5/2004 | Miller et al. | 446/125 |

* cited by examiner

*Primary Examiner* — Gene Kim
*Assistant Examiner* — Alyssa Hylinski
(74) *Attorney, Agent, or Firm* — Mark S. Hubert

(57) ABSTRACT

This invention generally relates to a set of parallelepipedal bodies (generally, cubes) capable of matingly compatible engagement for interconnection with substantially similar cubes. When a number of cubes are assembled into a cubic array, there can be slab movement, row movement or solo cube movement. Each cube is constructed from six plates with an interior physical configuration adapted for connective assembly and the strategic placement of electrostatic or electromagnetic motors or motor halves therein.

3 Claims, 10 Drawing Sheets

ROBOTIC CONSTRUCTION CUBES

This application is a continuation-in-part of application claiming benefit under 35 U.S.C. §121 U.S. non-provisional application Ser. No. 11/801,904 filed May 11, 2007. The benefit of which is claimed, is considered to be a part of the disclosure of the accompanying application and is hereby incorporated herein its entirety by reference.

TECHNICAL FIELD

This invention generally relates to a set of cubes, or generally parallelepipedal bodies and matingly conformed rails, capable of sliding engagement so as to allow variable single cube movement and placements within an array of substantially similar cubes and or rails. The desired end use is as a building block for robotic architecture capable of housing electromagnetic or electrostatic motors. However, puzzles and structural construction are a secondary adaptation. U.S. Pat. No. 7,198,270 KINEMATICALLY COMPATIBLE PARALLELEPIPED CELLS

BACKGROUND OF THE INVENTION

The present invention relates to a set of unique parallelepipedal cubes, capable of a hollow core construction. Each cube has six plates, the internal faces of which may matingly interlock in a synergistic design for assembly. Additionally, the external faces are matingly conformed and designed to slidingly engage one another such that when a multitude of cubes are assembled into an array, there can be slab movement, row movement, or solo cube movement in all three axes. Depending upon the exterior face configuration there may be one or a maximum of two different plates used in the assembly of each cube. All six of the interior faces in any cube, regardless of whether the cube has a single or two exterior face plate design, are substantially similar in physical configuration. The bar and trough configuration enables the strategic internal placement of electrostatic or electromagnetic motors or paired motor halves.

The exterior face design is such that all exterior faces matingly interlock for sliding engagement. In this manner the cubes are free to move about each other individually or in groupings, generally with three degrees of freedom, i.e., movement is allowed in each of the X, Y and Z axis.

The physical configuration of the interior face of each face plate maximizes the amount of hollow interior space while providing for a rigid unibody design wherein the strength of the cell is a synergistic function of all six face plates. The ease of fabrication is well suited for injection molding. A plethora of applicable uses are some of this invention's stronger features.

This invention's design overcomes the drawbacks of the prior art in that it greatly simplifies the mass fabrication of the cubes, while allowing ample interior room for the strategic placement of full or half electric motors.

SUMMARY OF THE INVENTION

In accordance with the invention, an object of the present invention is to provide an improved, enclosed hollow body cube, constructed with a minimum of generally planar plates.

It is another object of this invention to provide a cube for use in a portable puzzle where each of the cube's six faces can be cheaply and simply fabricated and assembled.

It is a further object of this invention to provide a set of enclosed body parallelepipedal cubes that allow each cube kinematic compatibility in up to three degrees of freedom.

It is yet a further object of this invention to provide a hollow body parallelepipedal cube constituting minimal different components.

It is yet a further object of this invention to provide a parallelepipedal cube with an internal void capable of housing electrostatic and electromagnetic motors in the most favorable arrangement.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Figure 1D:
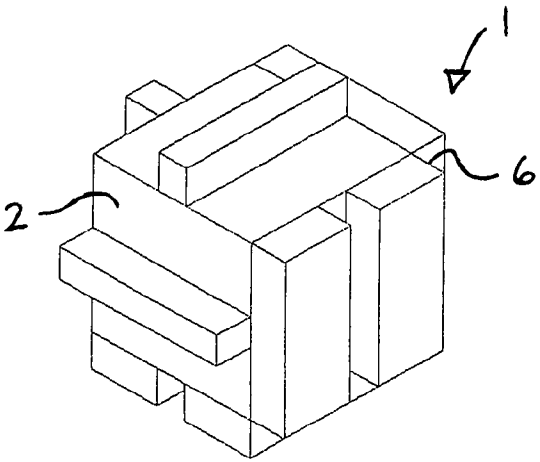
FIG. 1D is a perspective view of the preferred embodiment.
Figure 1C:
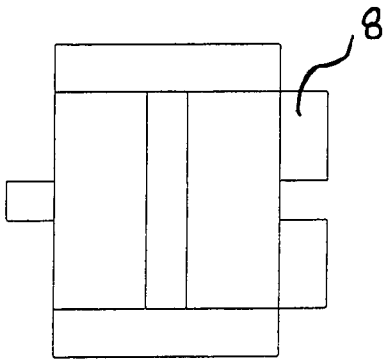
FIG. 1C is a side view of the preferred embodiment.
Figure 1A:
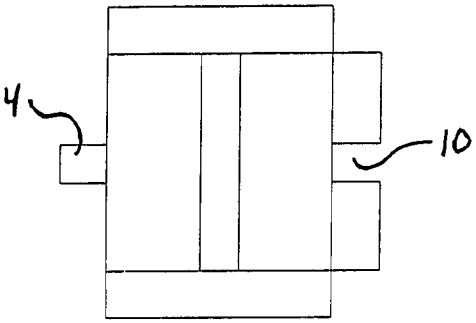
FIG. 1A is a top view of the preferred embodiment.
Figure 1B:
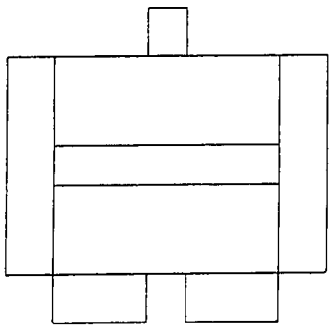
FIG. 1B is a front and back view of the preferred embodiment.
Figure 2D:
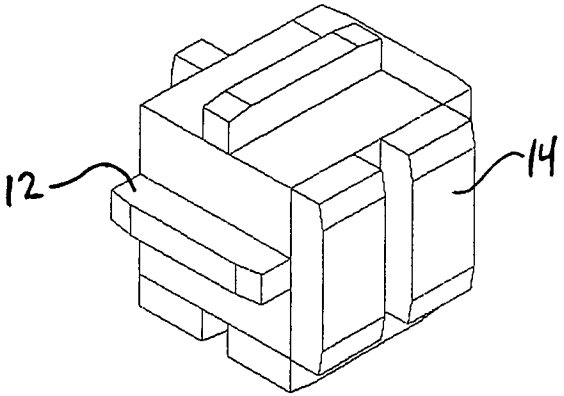
FIG. 2D is a perspective view of the first alternate embodiment.
Figure 2C:
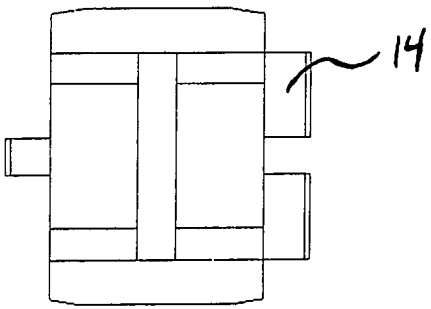
FIG. 2C is a side view of the first alternate embodiment.
Figure 2A:
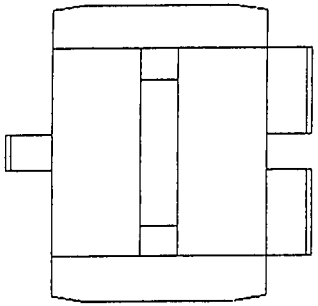
FIG. 2A is a top view of the first alternate embodiment.
Figure 2B:
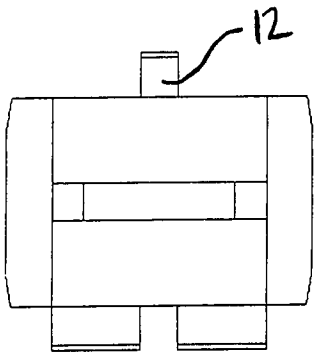
FIG. 2B is a front and back view of the first alternate embodiment.
Figure 3D:
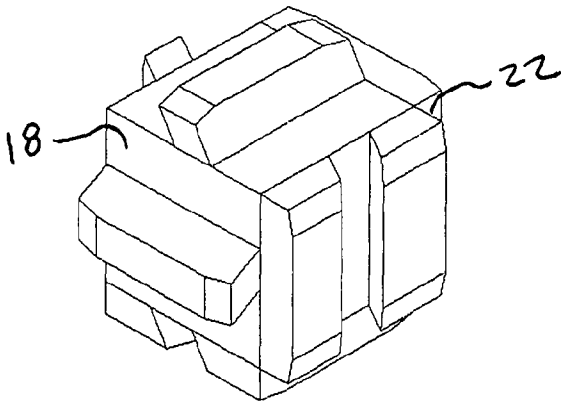
FIG. 3D is a perspective view of second alternate embodiment.
Figure 3C:
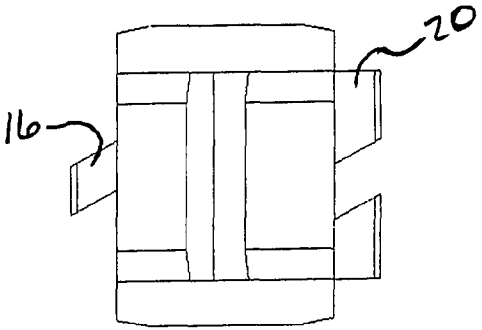
FIG. 3C is a side view of second alternate embodiment.
Figure 3A:
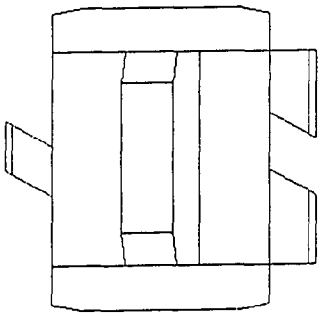
FIG. 3A is a top view of the second alternate embodiment.
Figure 3B:
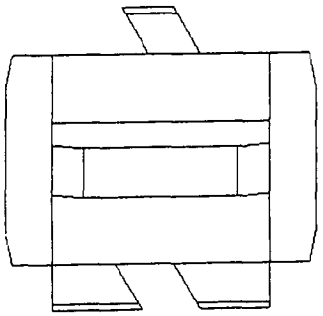
FIG. 3B is a front and back view of second alternate embodiment.
Figure 4D:
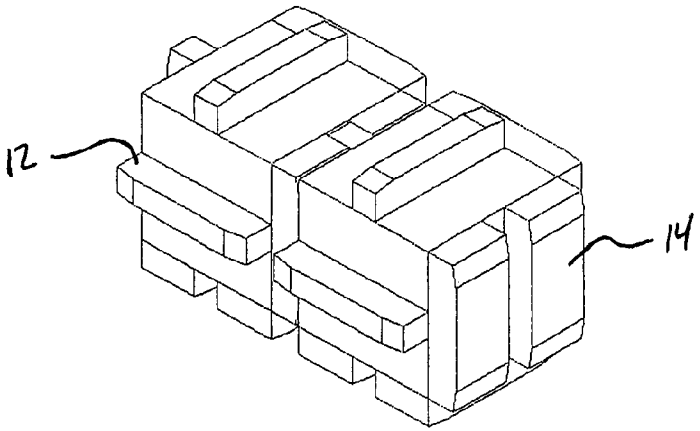
FIG. 4D is a perspective view of two matingly engaged cubes in the first alternate embodiment.
Figure 4C:
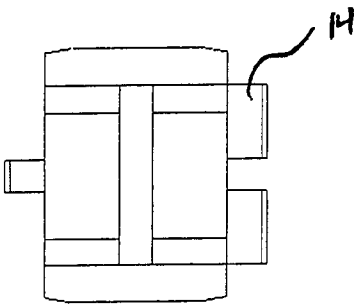
FIG. 4C is a side view of two matingly engaged cubes in the first alternate embodiment.
Figure 4A:
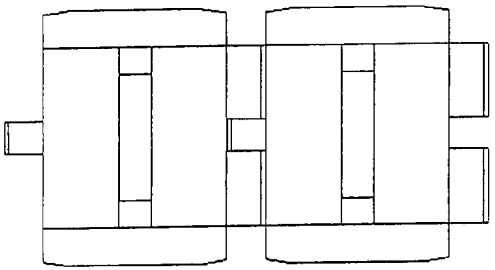
FIG. 4A is a top and bottom view of two matingly engaged cubes in the first alternate embodiment.
Figure 4B:
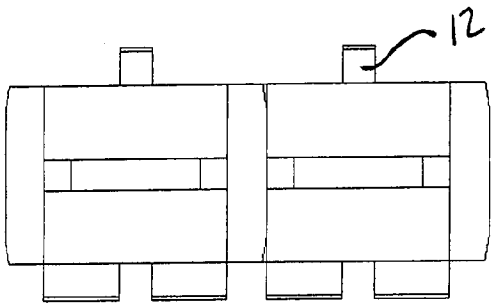
FIG. 4B is a front view of two matingly engaged cubes in the first alternate embodiment.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting. The design and structure of the present invention has its roots in the inventor's earlier allowed and issued U.S. Pat. No. 7,198,270 KINEMATICALLY COMPATIBLE PARALLELEPIPED CELLS. The interior and exterior face plate designs lend themselves to adaptation to both the plethora of 416 cubes using symmetrically centered design face plates and offset design face plates taught in U.S. Pat. No. 7,198,270.

For ease, cube assembly will be discussed in terms of exterior face design first and interior face design, second, any combination of thereof which can be combined. It is to be noted that although not discussed herein, plate pairs (or even plate triplets) of conjoined adjacent plates may be injection molded or otherwise fabricated to be unitary structures. Where symmetrically centered design face plates rather than offset design face plates are used for the assembly of a cube, two different but matingly engageable exterior face plates must be utilized. Where offset design face plates are used, only a single exterior face plate is necessary for the assembly of a cube. This is discussed in detail in U.S. Pat. No. 7,198,270 KINEMATICALLY COMPATIBLE PARALLELEPIPED CELLS. Referring to FIG. 1A-1D the preferred exterior cube assembly can be seen. Centered along the longitudinal axis of first exterior face plate 2 resides one bar 4 extending normally therefrom. Second exterior face plate 6 is configured to slidingly and matingly engage first exterior face plate 2. As such, second exterior face plate 6 has two parallel linear members 8 extending normally therefrom and one trough 10 formed therebetween. Trough 10 lies centered along the longitudinal axis of second exterior face plate 6 so as to slidingly and matingly engage bar 4 from exterior face plate 2. There may be a hollow interior space defined within the bars 4 and linear members 6 that house full or partial drive motors.

First exterior face plate 2 and second exterior face plate 6 have substantially similar length and width dimensions and are rectangular, but are not square. The length of each face plate is defined as the dimension parallel to the longitudinal axis of the linear members/bars thereon and is the largest single physical dimension of the face plates. The width of each face plate is defined as the dimension perpendicular to the longitudinal axis of the linear members/bars.

Assembly of cube 1 requires three of first exterior face plate 2 and three of second exterior face plate 6. The arrangement of all exterior face plates 2 is such that there is a common corner shared by all three of these first exterior face plates 2 and at the diagonal corner of cube 1 resides the common corner for the three second exterior face plates 6. The longitudinal axis of the trough on any exterior face on an assembled cube lies perpendicular to the longitudinal axis of the bar on any and all adjacent faces and the converse is also true.

It is also known, a matingly engageable, tapered edge formation of a bar 12 and tapered linear member 14 may also be utilized as an optional exterior face plate embodiment (first alternate exterior face plate embodiment) to any of the plates illustrated and described herein (FIGS. 2A-2D and 4A-4D and 5). This tapered edge allows for easier transition and alignment of cubes in movement. Although not discussed herein, it is well known in the industry to utilize tapers on all edges of the linear members.

Figure 5:
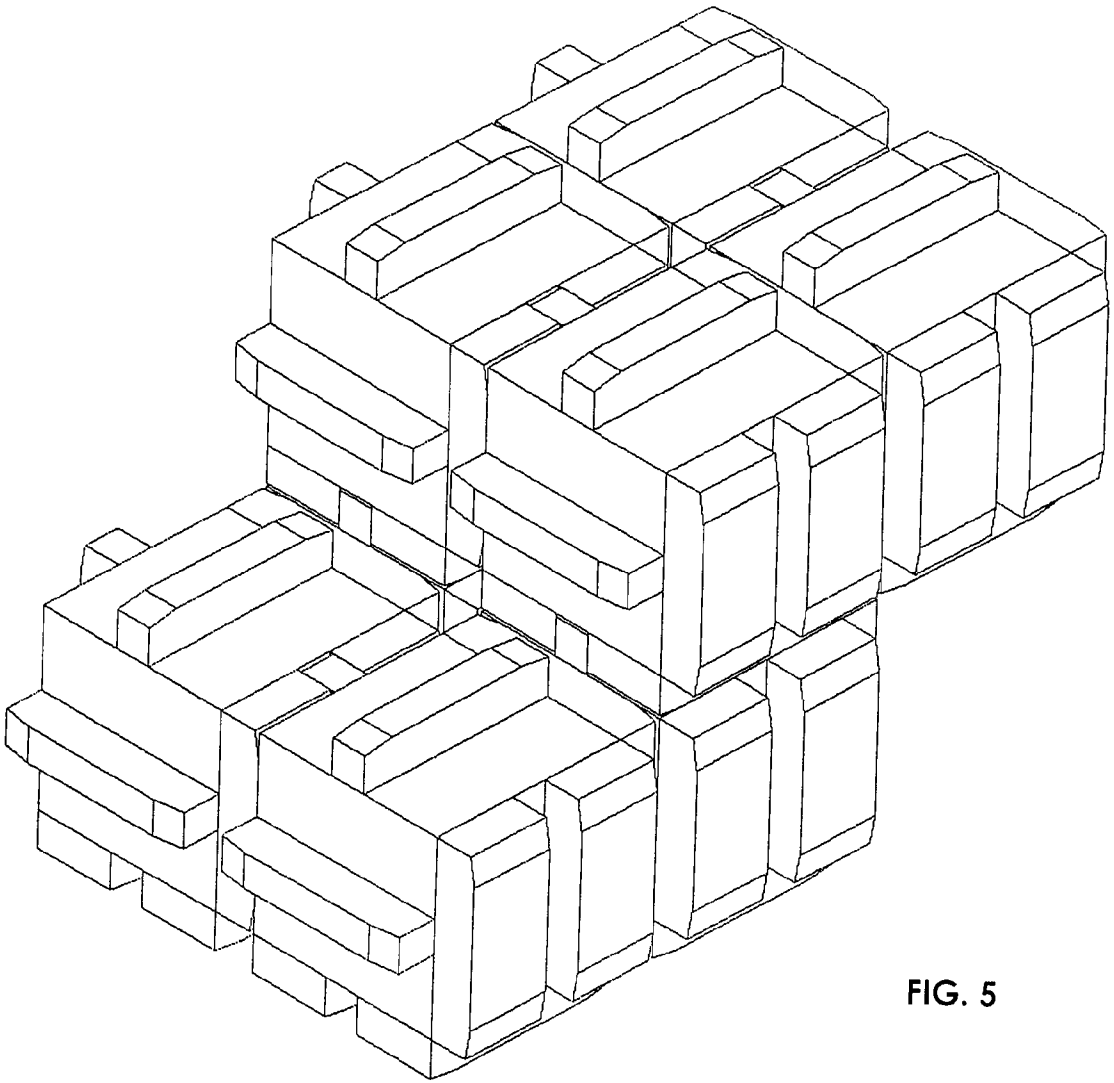
FIG. 5 illustrates eight matingly in the first alternate embodiment.
Figure 6D:
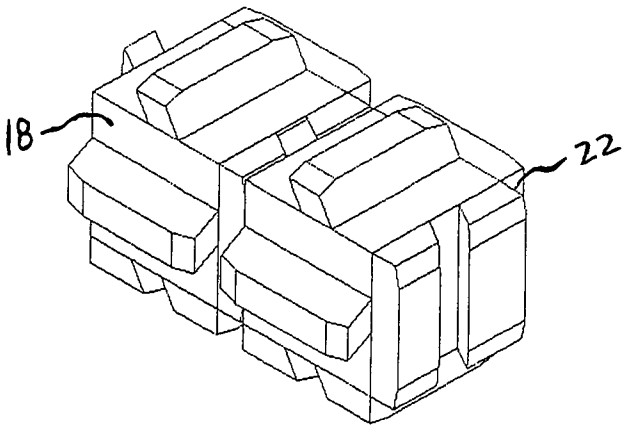
FIG. 6D is a perspective view of two matingly engaged cubes in the second alternate embodiment.
Figure 6C:
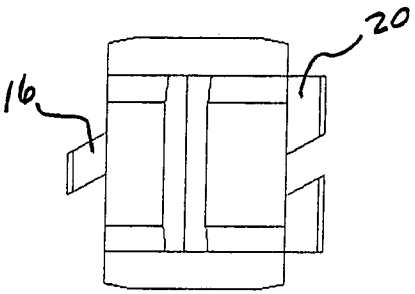
FIG. 6C is a side view of two matingly engaged cubes in the second alternate embodiment.
Figure 6A:
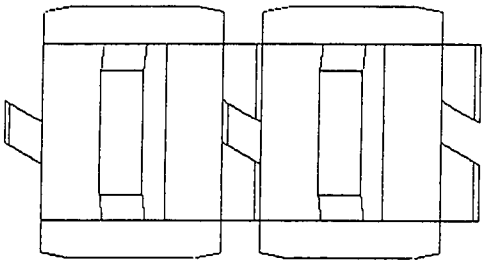
FIG. 6A is a top view of two matingly engaged cubes in the second alternate embodiment.
Figure 6B:
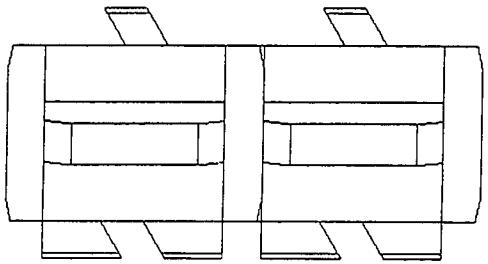
FIG. 6B is a front view of two matingly engaged cubes in the second alternate embodiment.
Figure 7D:
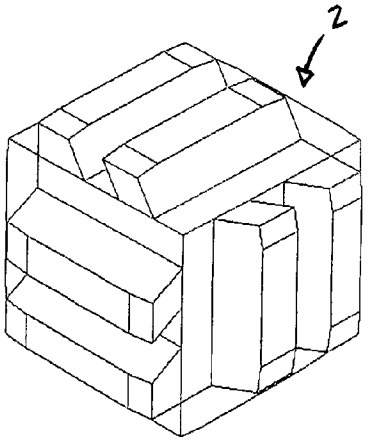
FIG. 7D is a perspective view of the third alternate embodiment.
Figure 7C:
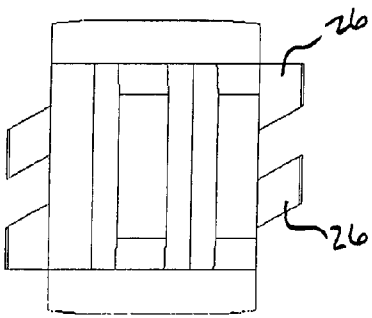
FIG. 7C is a side view of the third alternate embodiment.
Figure 7A:
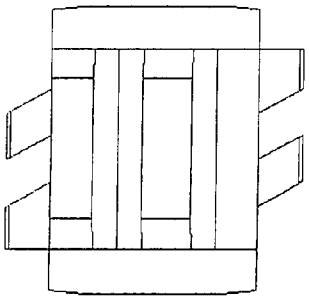
FIG. 7A is a top view of the third alternate embodiment.
Figure 7B:
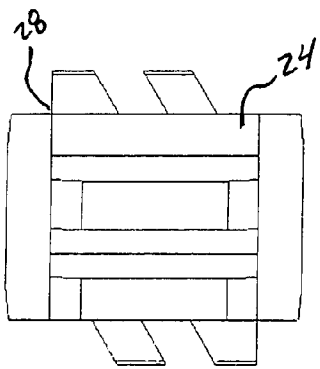
FIG. 7B is a front view of the third alternate embodiment.
Figure 8D:
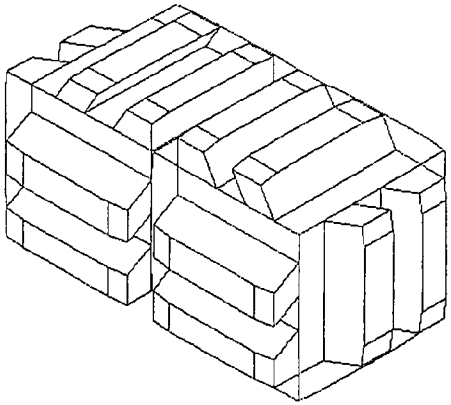
FIG. 8D is a perspective view of two matingly engaged cubes in the third alternate embodiment.
Figure 8C:
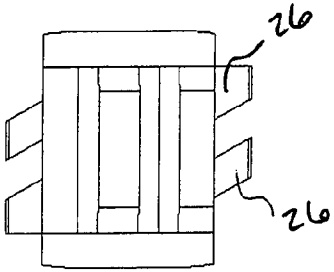
FIG. 8C is a bottom view of two matingly engaged cubes in the third alternate embodiment.
Figure 8A:
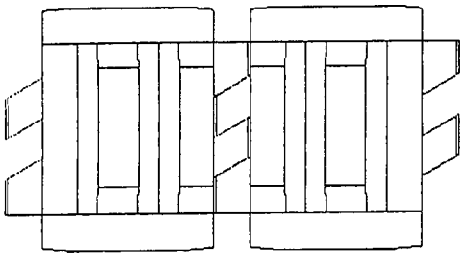
FIG. 8A is a top view of two matingly engaged cubes in the third alternate embodiment.
Figure 8B:
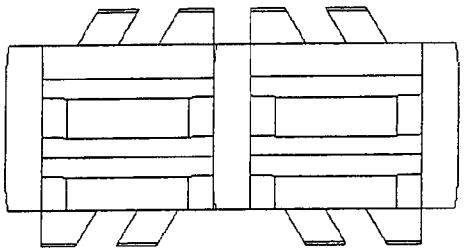
FIG. 8B is a front and back view of two matingly engaged cubes in the third alternate embodiment.

FIG. 5 illustrates eight matingly engaged cubes in the first alternate embodiment.

FIGS. 3A-3D and 6A-6D, illustrate an angled exterior face plate embodiment (second alternate embodiment) of both the bars and the linear members. Looking at FIGS. 6C and 6D it can be seen that a tapered, angled bar 16 extends at an angle from exterior face plate 18, and angled, tapered linear members 20, extend at a matingly complementary angle from exterior face plate 22.

FIGS. 7A-8D illustrate the third alternate exterior face plate embodiment wherein six substantially similar exterior face plates 24 are assembled to form cube 2, rather than three substantially similar first exterior face plates and three substantially similar second exterior face plates. Exterior face plate 24 has two offset, parallel, tapered, angled linear members 26 extending therefrom. In this embodiment the linear members 26 are offset such that one tapered, angled linear member 26 shares a common edge 28 with exterior face plate 24. It is to be noted that while FIGS. 7 and 8 show two offset, parallel, tapered, angled linear members 26 that have different axial cross sections (one trapezoidal and one rhomboidal) this configuration is not necessary. The two angled linear members 26 may be substantially similar.

Figure 9:
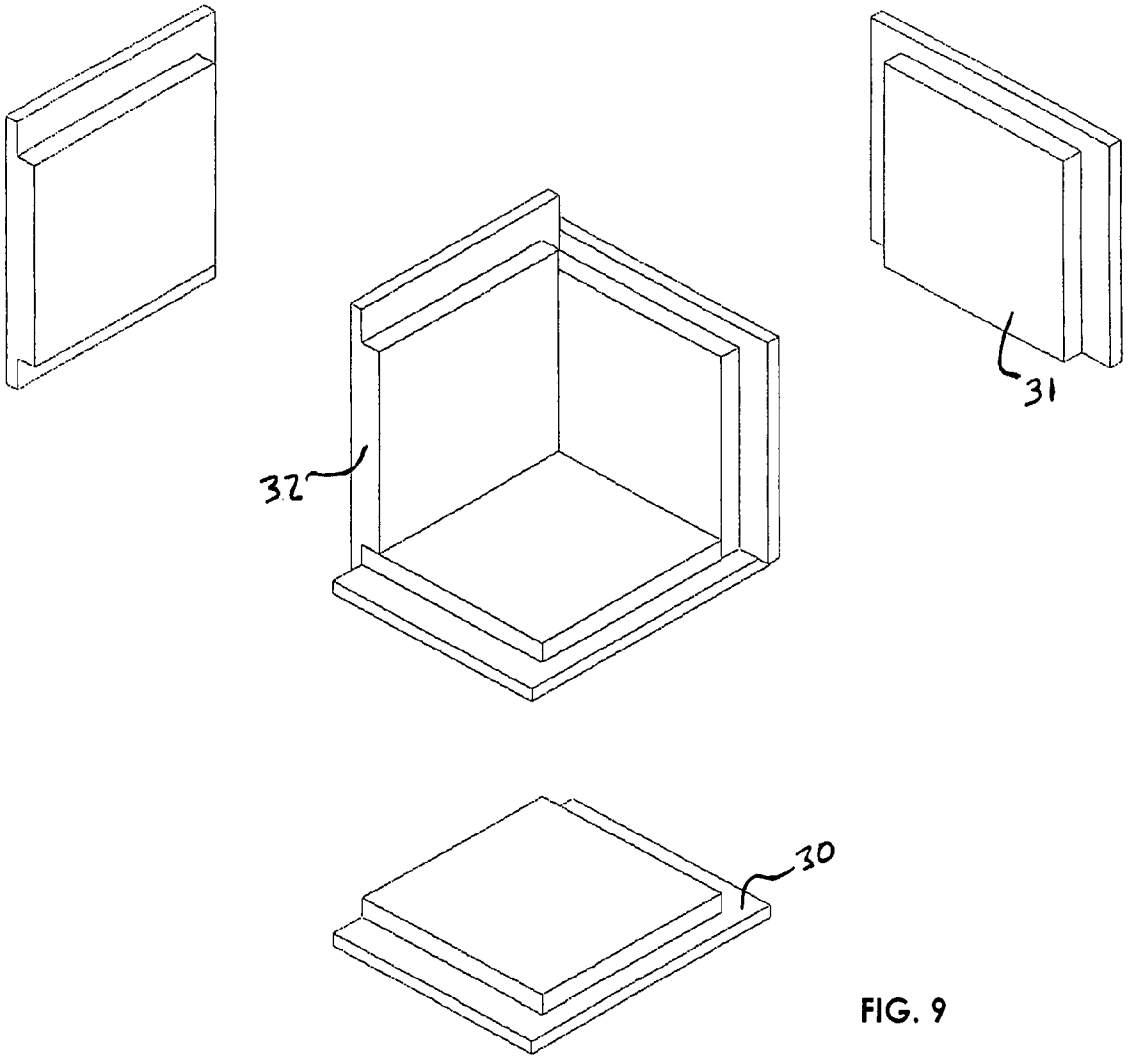
FIG. 9 is an exploded view of the partial assembly of preferred embodiment of the interior face plates.

Designed to work with any of the aforementioned exterior face plate configurations, the preferred embodiment for the physical configuration of interior face plate 30 is illustrated in FIG. 9. For visual clarity all external face features (i.e., bars and linear members) have been removed. Looking at FIG. 9 it can be seen that an offset raised platform 31 resides on interior face plate 30. The offset raised platform 31 has a smaller surface area than the exterior face 19. The offset raised platform 31 and interior face plate 30 share a common edge 32 such that there is symmetry about the width axis. The distance between the three remaining edges of platform 31 and the remaining edges of the face plate are not all the same.

Figure 10:
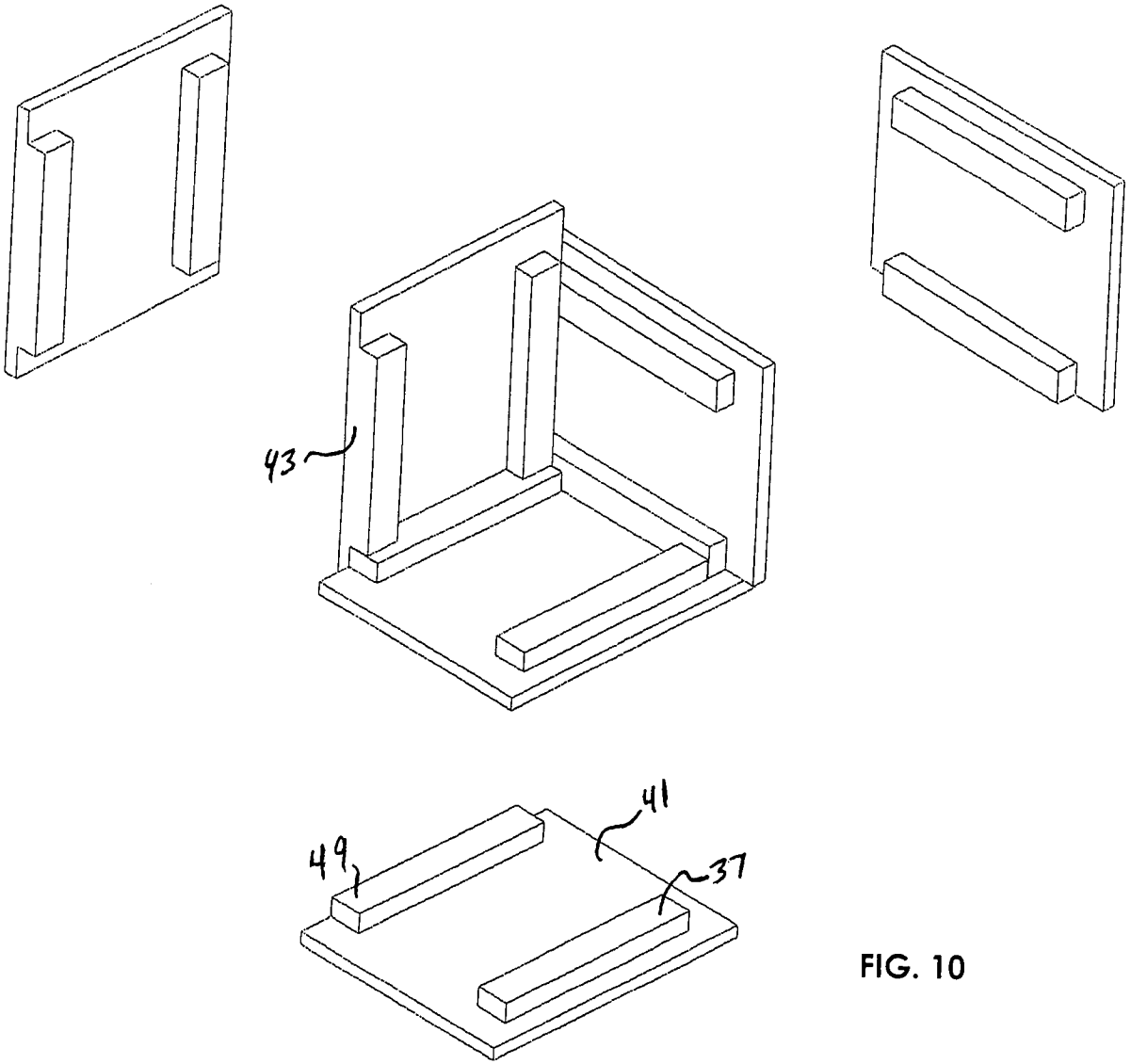
FIG. 10 is an exploded view of the partial assembly of the alternate embodiment of the interior face plates.

Looking at FIG. 10 an interior face plate alternate embodiment is illustrated. The same offset design is employed in the alternate embodiment as in the preferred embodiment; however, instead of an offset platform 31, a pair of offset parallel linear members 37 and 49 is employed. Although illustrated as angled linear members, these can also be rectangular rather than rhomboidal or trapezoidal in cross section. On the interior face plate 41 resides a first offset linear member 37 extending normally therefrom. A second offset linear member 49 shares a common edge 43 with interior face plate 41 such that there is symmetry about the width axis of interior face plate 41.

Now that the preferred embodiment and 5 alternate embodiments of the exterior face as well as the preferred and alternate embodiment interior face have been discussed, it can be seen that there are numerous possible variations of assembled cubes. The actual structure will be determined by the end application. The various configurations have their own advantages and differ in the amount of sliding friction, alignment and engage ability, ease of assembly, cell rigidity and production cost. Although the parallelepipedal structure has been discussed generally as having a cubic arrangement (wherein all plates reside perpendicular to it's four adjacent plates) that is not to limit the application of the structural principles and arrangement discussed herein to a cube. Functionally equivalent parallelepipedal structures may be formed wherein the structures may have at least two parallelogram plates rather than rectangular plates.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed.

The invention claimed is:

1. A six plate hollow parallelepipedal structure comprised of:

three oblong rectangular first plates each having a first rectangular top surface and a first rectangular bottom surface and having a dimension of length and a dimension of width; and three oblong rectangular second plates each having a second rectangular top surface and a second rectangular bottom surface and having a dimension of length and a dimension of width;

wherein said first rectangular top surface further comprises a bar traversing the length of said first top surface centered along a longitudinal axis of said first top surface and said second rectangular top surface further comprises two substantially similar linear members traversing the length of said second top surface and residing parallel to but offset from a longitudinal axis of said top surface such that a trough is formed there between said linear members, and wherein when said first rectangular plates and second rectangular plates are assembled into said parallelepipedal structure, said longitudinal axis of each said first and second rectangular plates resides perpendicular to said longitudinal axes of all rectangular first and second plates with which it shares a single common edge;

wherein said trough is dimensioned to matingly engage said bar so as to allow sliding engagement with one another, such that when a multitude of parallelepipedal structures are assembled into an array, the individual structures are free to move about each other individually or in groupings such that there can be slab movement, row movement, or solo cube movement in an X axis, a Y axis and a Z axis by the complementary engagement of said trough and bar; and wherein said first and second bottom surfaces have two length edges and two width edges and further comprise a first and a second substantially similar linear members extending normally from said first bottom surface and said second bottom surface wherein said first linear member resides adjacent to a length edge and said second linear member resides parallel to said first member such that the said first and second bottom surfaces of said first and second plates are mechanically directly engageable to enable three first plates and three second plates to form a parallelepipedal structure.

2. A six plate hollow parallelepipedal structure comprised of:

three oblong rectangular first plates each having a first rectangular top surface and a first rectangular bottom surface and having a dimension of length and a dimension of width; and three oblong rectangular second plates each having a second rectangular top surface and a second rectangular bottom surface and having a dimension of length and a dimension of width;

wherein said first rectangular top surface further comprises a bar traversing the length of said first top surface centered along a longitudinal axis of said first top surface and said second rectangular top surface further comprises two substantially similar linear members traversing the length of said second top surface and residing parallel to but offset from a longitudinal axis of said top surface such that a trough is formed there between said linear members, and wherein when said first rectangular plates and second rectangular plates are assembled into said parallelepipedal structure, said longitudinal axis of each said first and second rectangular plates resides perpendicular to said longitudinal axes of all rectangular first and second plates with which it shares a single common edge;

wherein said trough is dimensioned to matingly engage said bar so as to allow sliding engagement with one another, such that when a multitude of parallelepipedal structures are assembled into an array, the individual structures are free to move about each other individually or in groupings such that there can be slab movement, row movement, or solo cube movement in an X axis, a Y axis and a Z axis by the complementary engagement of said trough and bar;

wherein said bar and said linear members have tapered leading edges, and wherein said first and second bottom surfaces have two length edges and two width edges and further comprise a first and a second substantially similar linear members extending normally from said first bottom surface and said second bottom surface wherein said first linear member resides adjacent to a length edge and said second linear member resides parallel to said first member such that the said first and second bottom surfaces of said first and second plates are mechanically directly engageable to enable three first plates and three second plates to form a parallelepipedal structure.

3. A six plate hollow parallelepipedal structure comprised of:

six substantially similar rectangular plates each having an oblong rectangular top surface and an oblong rectangular bottom surface and having a dimension of length and a dimension of width;

wherein said dimension of length exceeds said dimension of width and wherein said top surface further comprises at least two linear members traversing the length of said top surface and residing parallel to but offset from a longitudinal axis residing in the length dimension of said top surface, and wherein when said rectangular plates are assembled into said parallelepipedal structure, said longitudinal axis of each plate resides perpendicular to said longitudinal axes of all substantially similar rectangular plates that are connected along a single common edge, and wherein said linear members are conformed for sliding engagement with linear members on a substantially similar six plate hollow parallelepipedal structure such that when a multitude of parallelepipedal structures are assembled into an array, the individual structures are free to move about each other individually or in groupings such that there can be slab movement, row movement, or solo cube movement in an X axis, a Y axis and a Z axis by a complementary engagement of said linear members; and wherein said bottom surface has two length edges and two width edges and further comprises a first and a second substantially similar linear members extending normally from said bottom surface wherein said first linear member resides adjacent to a length edge and said second linear member resides parallel to said second member such that the said rectangular bottom surfaces of said first and second plates are mechanically directly engageable to enable the rectangular plates to form a parallelepipedal structure.

* * * * *